United States Patent [19]

Reiche

[11] 4,173,239

[45] Nov. 6, 1979

[54] METHOD OF AND APPARATUS FOR CONTROLLING THE FLOW OF MATERIALS FROM A ROTATING DRUM

[75] Inventor: Robert F. Reiche, Wheaton, Ill.

[73] Assignee: Chicago Bridge & Iron Company, Oak Brook, Ill.

[21] Appl. No.: 814,975

[22] Filed: Jul. 12, 1977

[51] Int. Cl.[2] ..... B27L 1/00

[52] U.S. Cl. ..... 144/311; 51/164.1; 144/208 B; 222/167; 241/171

[58] Field of Search ..... 241/171, 180; 222/167; 144/208 R, 208 B, 311; 51/164

[56] References Cited

U.S. PATENT DOCUMENTS

| | | | |
|---|---|---|---|
| 2,131,260 | 9/1938 | Temple | 51/164 |
| 2,392,245 | 1/1946 | Huszar | 222/167 X |
| 2,429,627 | 10/1947 | Huszar | 241/171 |
| 3,262,477 | 7/1966 | O'Brien | 144/208 B |
| 3,417,796 | 12/1968 | Leider et al. | 144/208 B |
| 4,062,476 | 12/1977 | Brand et al. | 222/131 |

*Primary Examiner*—Robert L. Spruill
*Assistant Examiner*—W. D. Bray
*Attorney, Agent, or Firm*—Merriam, Marshall & Bicknell

[57] ABSTRACT

A material discharge regulating gate, for a rotating material processing drum, having a vertical circular member having a diameter larger than the discharge end of the drum, the circular member having a continuous surface with a material discharge opening therein, and means for rotatably mounting the circular member adjoining the discharge end of the rotatable drum.

Apparatus comprising a rotatable material processing cylindrical drum having a substantially horizontal axis and a circular discharge open end, a material discharge regulating gate adjoining the discharge end of the drum, said gate comprising a vertical circular member having a diameter larger than the discharge end of the rotatable drum, the circular member having a continuous surface with a material discharge opening therein, and means for rotatably mounting the circular member adjoining the discharge end of the rotatable drum to rotate independent of the drum.

A method of regulating and controlling material flow or discharge from a rotating drum by positioning a vertical circular member at the discharge end of a rotatable drum, the circular member having a continuous surface with a material discharge opening therein and also having means for rotatably mounting the circular member adjoining the discharge end of the rotatable drum, rotating the drum, feeding material to the rotating drum for processing, and after processing discharging the material from the rotating drum with controlled flow by rotating the circular member to position the opening at a stationary location to effect controlled flow material discharge from the rotating drum through the opening in the circular member.

24 Claims, 12 Drawing Figures

FIG. 5
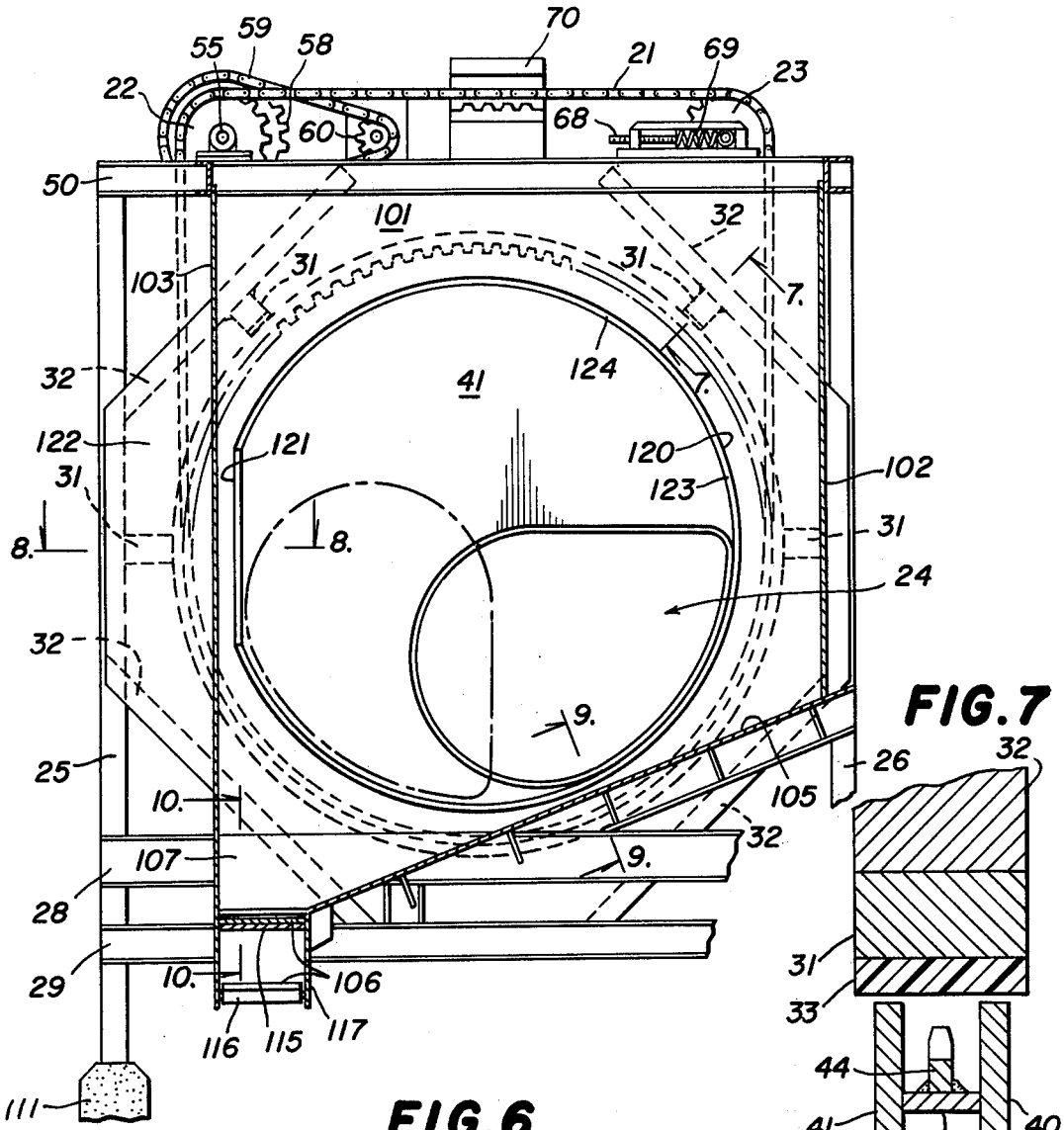
FIG. 7
FIG. 6
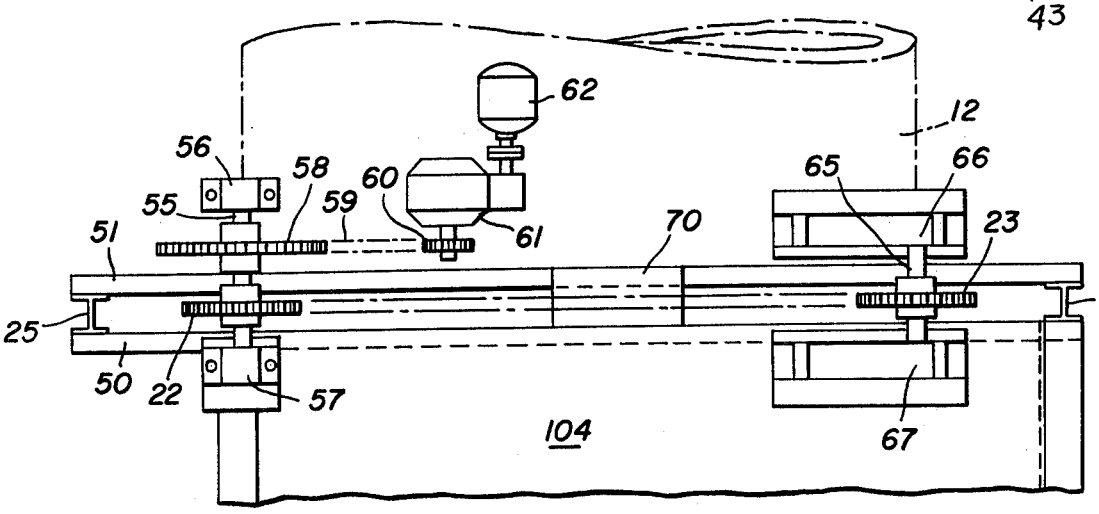

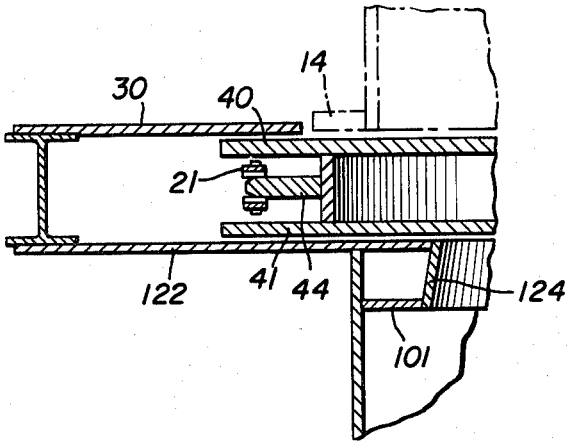
FIG. 8
FIG. 9
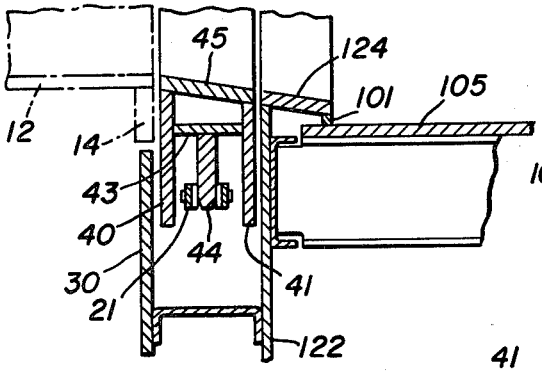
FIG. 10
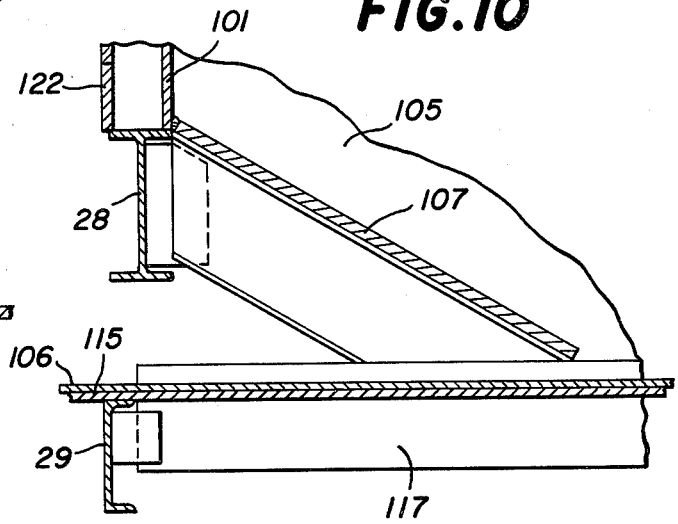
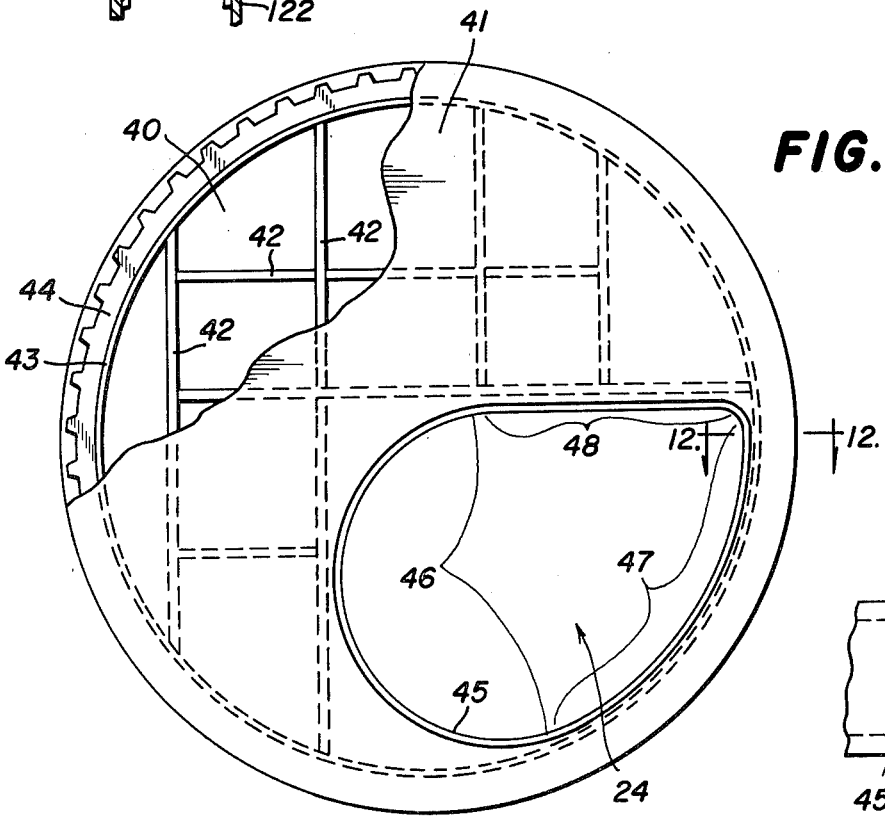
FIG. 11
FIG. 12
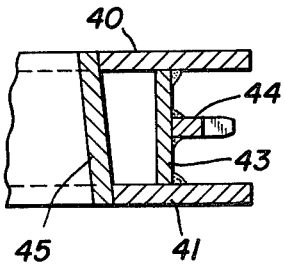

METHOD OF AND APPARATUS FOR CONTROLLING THE FLOW OF MATERIALS FROM A ROTATING DRUM

This invention relates to industrial apparatus which employs a substantially horizontally positioned rotating drum to process material. More particularly, this invention is concerned with apparatus and methods for use in combination with a rotating drum to control the material load volume in the drum and to regulate and guide its discharge flow, movement and path.

Many industrial processes employ a rotating horizontal metal drum for processing heavy solid materials. The drum is usually rotatably supported in one of three ways. One way is to suspend the drum cradled in a pair of spaced-apart nontraveling chains containing wheels in contact with a track around the drum. See U.S. Pat. No. 3,863,902. Another way is to suspend the drum in a pair of spaced-apart endless traveling chains. The endless chains run or travel on bar rings mounted on the drum at the same speed as the rotating drum. See U.S. Pat. No. 3,269,438. The third usual way to support a drum is on trunnion wheels. See U.S. Pat. Nos. 3,262,477; 3,701,487; 3,709,268; and 3,783,918.

After the processing of some materials in a rotating drum it is sufficient to let the processed material spill out the rotating drum through the end open for the diameter of the drum. Other materials, however, must be kept in the drum by means of a gate at the discharge end which opens when processing is completed to permit discharge of the processed material. Such gates may be mounted independently of the drum in an arrangement whereby the gate is generally stationary when the drum rotates.

One of the important uses of rotating drums is in debarking logs to prepare the wood for conversion to chips for wood pulping in paper manufacturing. Bark covered logs are fed into one end of a rotating drum. The rotation of the drum causes the logs to tumble and as a result of friction between the logs, and between the logs and drum, the bark is loosened and removed. The debarked logs are then discharged at the other end of the rotating drum.

For increased efficiency in removing bark it is advisable to regulate the load level in the rotating drum by preventing the logs from spilling unrestrictedly out a fully-open drum end. By maintaining an increased load level in the drum greater friction and abrasion of the logs results from each drum revolution than when the load level is lower. Various types of horizontally movable plate gates, as well as vertically movable plate gates, have been proposed and used to control the drum log load level but none are satisfactory when very long logs, i.e. 15 feet or larger than the drum diameter, are being debarked. The controlled discharge of very long logs from a drum has been an unsolved problem for many years. The disoriented tumbling and thrashing of long logs out of the discharge end of a drum pounds and batters receiving chutes and conveyors with forces of great magnitude, causing damage and unacceptable equipment attrition. As a result a need exists for apparatus and methods which can be used in combination with a rotating drum to control the material load in the drum and regulate the load discharge, such as in a continuous log debarking process.

According to one aspect of the invention there is provided a method of regulating and controlling material flow or discharge from a rotating drum by positioning a vertical circular member at the discharge end of a rotatable drum, the circular member having a continuous surface with a material discharge opening therein and also having means for rotatably mounting the circular member adjoining the discharge end of the rotatable drum, rotating the drum, feeding material to the rotating drum for processing and, after processing, discharging the material from the rotating drum with controlled flow by rotating the circular member to position the opening at a stationary location to effect controlled flow material discharge from the rotating drum through the opening in the circular member.

According to another, but apparatus aspect of the invention, there is provided a novel material discharge regulating gate for a rotating material processing drum comprising a vertical circular member having a diameter larger than the discharge end of a rotatable drum with which it can be used. The circular member has a continuous surface with a material discharge opening therein, and means for rotatably mounting the circular member adjoining the discharge end of the rotatable drum.

According to a further aspect of the invention there is provided apparatus comprising the combination of a rotatable material processing cylindrical drum having a substantially horizontal axis and a circular discharge open end, a material discharge regulating gate adjoining the discharge end of the drum, said gate comprising a vertical circular member having a diameter larger than the discharge end of the rotatable drum, the circular member having a continuous surface with a material discharge opening therein, and means for rotatably mounting the circular member adjoining the discharge end of the rotatable drum to rotate independent of the drum.

Although the gate is rotatably mounted at the end of the drum the gate will generally be stationary during continuous processing of material in the drum and during continuous discharge of the processed material through the gate discharge opening. Nevertheless, the rotatability of the gate is an important feature of the invention since it permits the gate discharge opening position to be changed to in that way increase or decrease the material load level in the drum. This is particularly advantageous when the feed stock, such as logs, fed to the drum varies greatly in length and diameter. The ability to completely empty the drum is also facilitated by being able to rotate the gate to put the gate discharge opening in optimum position for this purpose.

It is generally advisable to shape the discharge opening so that it has, in part, a peripheral edge portion which is flush with the drum discharge end to permit material discharged from the drum to flow unimpeded over that edge portion. Also, the discharge opening can include an approximately semicircular portion which extends from one end of the peripheral edge portion and ends in an approximately straight portion which extends to the other end of the peripheral edge portion.

It is also desirable, when the apparatus is used for log debarking, to so construct the drum as to have a smooth internal wall surface extending axially inwardly from the drum discharge end about 3 to 6 feet to better control log discharge from the drum and through the gate opening.

In a specific embodiment of the invention the gate is provided with a sprocket ring around the periphery of the circular member, and the mounting means comprises means for suspending the circular member including a chain which meshes with the sprocket and cradles the circular member. The sprocket ring is desirably located in a trough. The chain can be an endless chain, and the chain can be supported by at least two spaced-apart sprockets above the circular member. Power means is included to drive the chain and to thereby rotate the circular member. Also, advisably included is means to temporarily lock the chain against travel and thereby prevent rotation of the circular member. Guide means are most generally incorporated to restrain movement of the circular member axially and radially of the drum.

A chute is generally placed adjoining the gate for receiving processed material as it comes out of the gate discharge opening. In this regard, the rotatable position gate simplifies the discharge conveyor arrangement when two rotating drums operate parallel to each other.

The drum included in the apparatus combination may be trunnion wheel supported, rotatably supported by non-traveling chains or by traveling endless chains.

The invention will be described further in conjunction with the attached drawings in which:

FIG. 5 is a sectional view taken along the line 5—5 of FIG. 3;

FIG. 6 is a plan view of the gate as shown in FIG. 5 and of the gate rotating drive mechanism;

FIG. 7 is a sectional view taken along the line 7—7 of FIG. 5;

FIG. 8 is a sectional view taken along the line 8—8 of FIG. 5;

FIG. 9 is a sectional view taken along the line 9—9 of FIG. 5;

FIG. 10 is a sectional view taken along the line 10—10 of FIG. 5;

FIG. 11 is an elevational view of the discharge gate shown in FIGS. 3 to 10 showing fabrication details; and FIG. 12 is a sectional view taken along the line 12—12 of FIG. 11.

So far as is practical, the same numbers will be used in the drawings and the following description thereof to identify the same or similar elements or parts.

Figure 1:
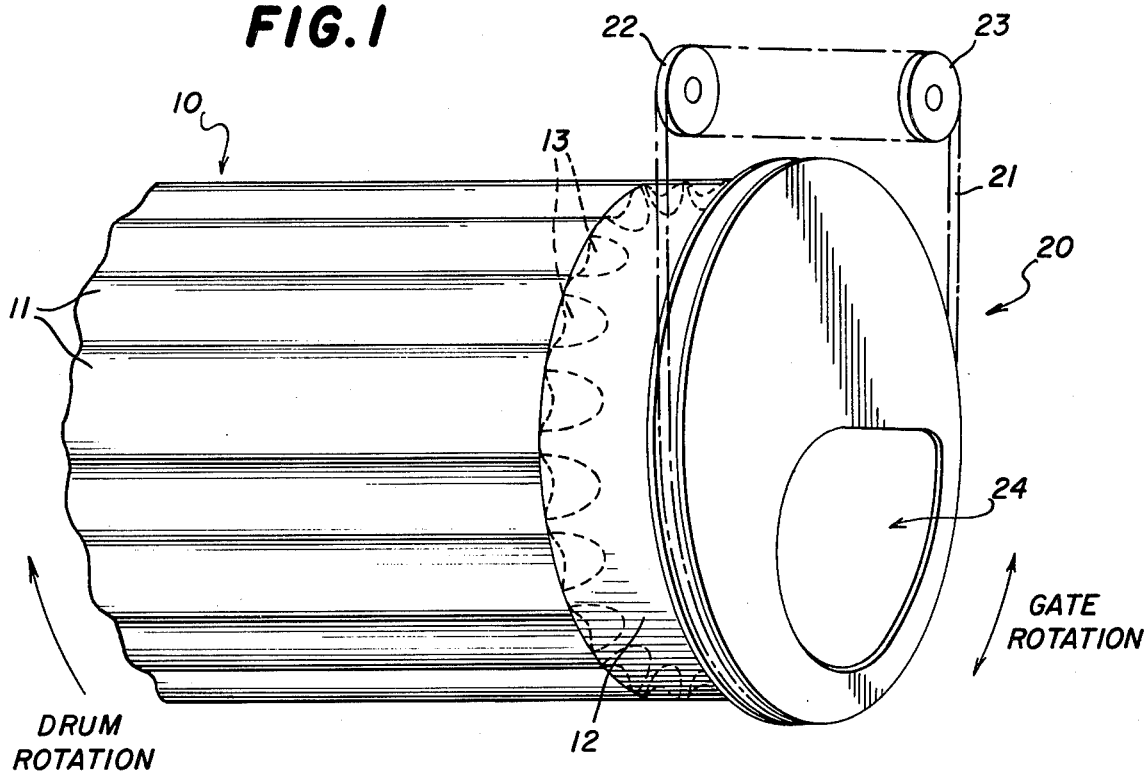
FIG. 1 is an isometric partially schematic view of a discharge regulating gate provided by the invention positioned at the end of a barking drum.

With reference to FIG. 1, the circular vertically positioned log discharge regulating gate 20 is positioned axially at the discharge end of barking drum 10. Although not shown in the drawings, drum 10 may be rotatably supported by trunnions, endless chains or double ended chains according to the suspension systems disclosed in the prior art patents referred to above and completely incorporated herein by reference. Drum 10 contains conventional longitudinal smoothly curved axially positioned corrugations 11. The drum 10 has a terminal smooth cylindrical portion 12 having a diameter equal to the external diameter of the drum corrugated portion. Transition baffles 13, shown in dotted lines, slopedly extend from the corrugation ends to the adjacent edge of cylindrical portion 12 to prevent wedging of logs in the rotating drum against the stationary gate. Furthermore, the internally smooth surfaced portion 12 aids in achieving controlled directional orientation of logs discharged from the drum into the gate 20. Flange 14 (FIGS. 8 and 9) is positioned around the discharge end of drum 10 for reinforcement.

Gate 20, in the form of a vertical circular member, is rotatably suspended by an endless chain 21 which rolls on spaced-apart sprockets 22 and 23. Log discharge opening 24 in gate 20 communicates both with the drum interior and with log receiving chute 100. The rate of flow of logs from the drum through the gate is controllable by the size and shape of the opening 24 as well as by its vertical position. In general, if the gate is compared to a clock-face, and the drum is rotated in the direction shown in FIG. 1, it is generally advisable to have the log discharge opening at least partially, and generally substantially, in the clock-face quadrant from 3 to 6 o'clock for continuous log barking. To empty the drum, it is advisable to rotate the gate so that the log discharge opening is located in the 6 to 9 o'clock quadrant. With various sized diameter logs and log lengths, the discharge opening will generally be found to be optimally located in the 3 to 6 o'clock quadrant, or partially in that quadrant and partially in the 6 to 9 o'clock quadrant as, for example, in the 4 to 7 o'clock quadrant.

Figure 2:
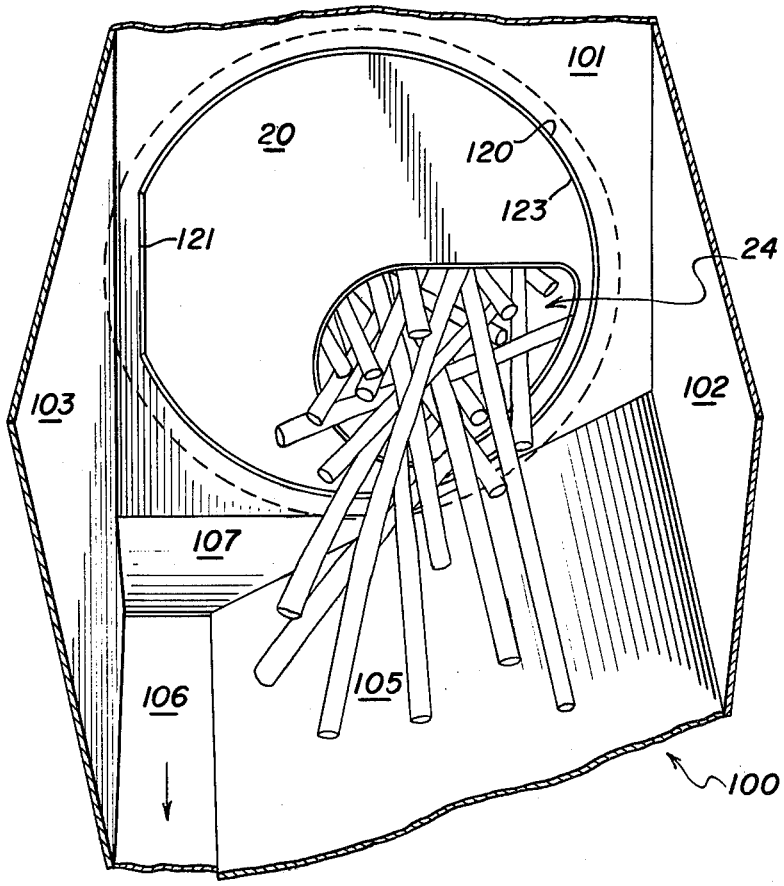
FIG. 2 is an isometric view of a log chute, which may be used in conjunction with the drum discharge gate of FIG. 1, positioned on the exit side of the gate.
Figure 3:
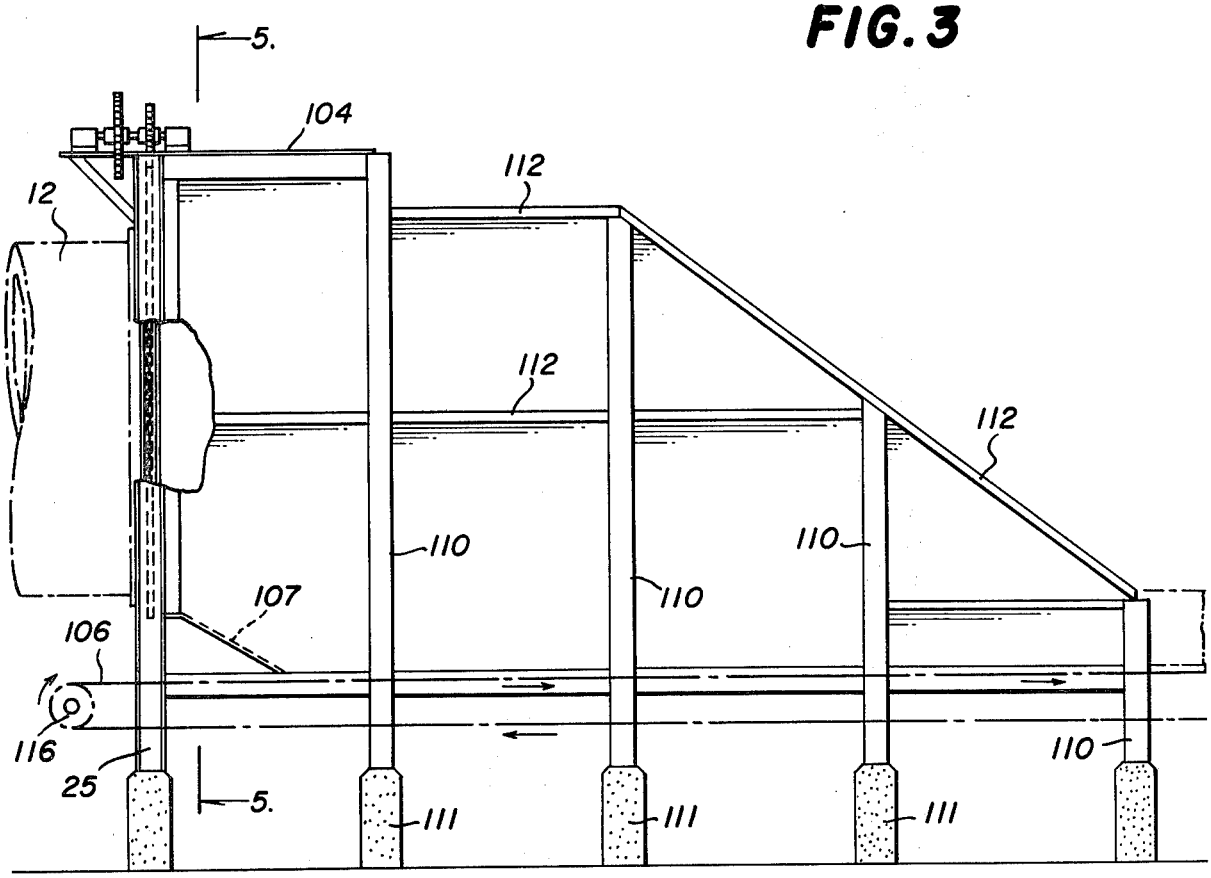
FIG. 3 is a side elevational view of the log chute shown in FIG. 2.
Figure 4:
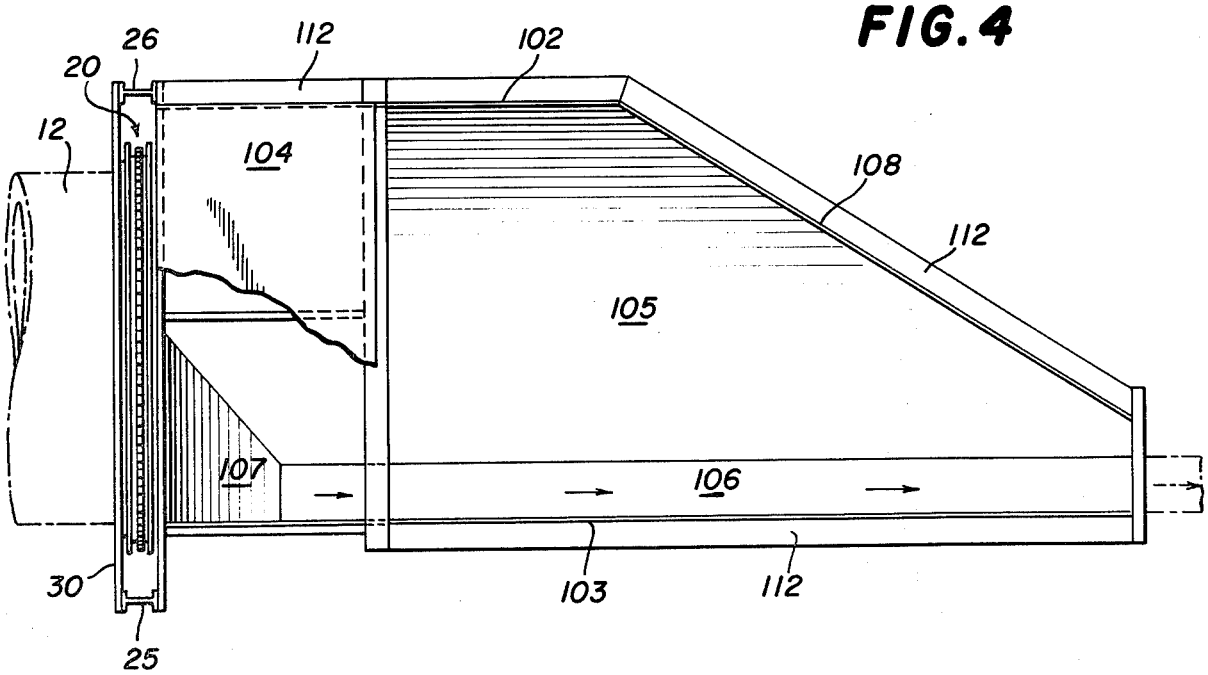
FIG. 4 is a plan view of the log chute shown in FIGS. 2 and 3.

With reference to FIGS. 2 to 4, a log chute 100, which can be used in conjunction with the log discharge gate 20, has an end wall 101, back wall 102, a front wall 103, a partial roof or cover 104 and a bottom 105 which slopes sidewardly downwardly and ends at conveyor belt 106 which moves the bark free logs to storage or directly to a chipping plant for use in pulp manufacture. Conveyor belt 106 is supported on plate 115 (FIG. 10). It returns supported on rollers 116. Vertical plate 117 provides a side guide for the conveyor belt and support for the lower edge of bottom 105. Forward sloping plate 107 is positioned with its upper horizontal edge welded to end wall 101, its lower edge welded to bottom 105 and its vertical end welded to front wall 103. Plate 107 aids in delivery of the discharged logs to the conveyor belt. Also, vertical rear wall 108 (FIG. 4), joined to back wall 102, is angled forwardly to further promote movement of the logs towards the conveyor belt 106.

The front, back walls and bottom of the chute are supported by columns 110 in foundations 111 and beams 112 are further employed to reinforce and stiffen these parts of the chute.

The primary support for the gate system is a pair of spaced-apart vertical columns 25 and 26 (FIGS. 3 to 6), top beams 50 and 51, and bottom beams 28 and 29 which are joined to the columns. A vertical plate 30 is placed on the drum side of columns 25 and 26 and this plate is provided with a cut-out circular opening slightly larger than the diameter of flange 14 (FIG. 9) on the end of drum portion 12. The chute end wall 101 is provided with a generally circular opening 120 with a vertical straight edge portion 121 adjacent chute front wall 103. To the rear, towards the gate, is a second wall 122 having an opening 123 like opening 120 but slightly smaller. The internal periphery of openings 120 and 123 is spanned by slanting lip plate 124 (FIGS. 8 and 9) which forms a smooth transition with portion 47 of the gate discharge opening.

The opening 24 of the gate will usually be located about as shown in FIG. 5 during continuous log debarking operations. The shape of the opening and its location control log discharge from the rotating drum with a safe and consistent flow, greatly reducing impact and damage to stationary discharge chutes. This is a particular benefit with long logs greater in length than the internal diameter of the drum. When it is desired to completely empty the rotating drum the gate is rotated so that the opening 24 is positioned stationary as shown in phantom by the dot-dash line in that figure.

The gate 20 is positioned between plate 30 and chute end wall 101. It is limited in radial movement by bumpers 31 (FIGS. 5 and 7) supported by braces 32. A replaceable bearing block 33 of wear resistant material such as nylon or polypropylene may be put on the end of each bumper 31.

The specific gate shown in the drawings has a circular rear flat face plate 40 and a circular front flat face plate 41 joined to a network of criss-crossing braces 42 by welding. The described structure is in the form of a vertical circular member. After the braces are welded to one of the face plates, the second face plate can be welded to the braces through slots cut in the face plate. A ring 43 is welded between, and radially in from the peripheral edges of, the face plates 40 and 41 thereby forming a trough. A ring sprocket 44 is welded on ring 43 in the trough to receive chain 21 to thereby rotatably suspend the gate.

Log discharge opening 24 in gate 20 is formed by identically shaped cut-out portions in face plates 40 and 41 but with the opening in front face plate 41 slightly larger than the opening in rear face plate 40. The space between the face plates at the opening 24 is covered by a plate 45 (FIGS. 9, 11 and 12) which slants outwardly to form a mouth larger on the exit than on the inlet side. Also, the gate discharge opening has a peripheral edge portion on the rear face which extends radially beyond the drum discharge end to permit logs discharged from the drum to flow unimpeded over that edge portion.

The specific log discharge opening 24 shown in the drawings has an approximately semicircular portion 46 which extends from one end of the peripheral edge portion 47, and ends in an approximately straight portion 48 which extends to the other end of the peripheral edge portion.

A pair of horizontal channel beams 50 and 51 extend from the top of column 25 to the top of column 26 (FIG. 6) and support sprockets 22 and 23. Sprocket 22 is mounted on axle 55 which rotates in bearings 56 and 57 (FIGS. 5 and 6). Sprocket 58 is also mounted on axle 55 and is driven by chain 59 by means of sprocket 60 on reduction gear box 61 which is driven by motor 62. Motor 62 is reversible so that the gate can be rotated in either direction. Sprocket 23 (FIGS. 5 and 6) is mounted on axle 65 which is supported by bearings 66 and 67 which are adjustable by screw 68 and spring 69 so that the slack in chain 21 may be increased or decreased and to absorb shock loads imposed by logs passing through the gate. Chain clamping device 70 serves to prevent rotation of the gate after it is placed in a desired position.

The foregoing detailed description has been given for clearness of understanding only, and no unnecessary limitations should be understood therefrom, as modifications will be obvious to those skilled in the art.

What is claimed is:

1. Apparatus comprising:

a rotatable material processing cylindrical drum having a substantially horizontal axis and a circular discharge open end, said drum being supported for rotation$by means which contacts the outside of the drum, a material discharge regulating gate adjoining the discharge end of the drum and separate from the drum, said gate comprising a vertical circular member having a diameter larger than the discharge end of the rotatable drum, the circular member having a continuous surface with a material discharge opening therein, and means for rotatably mounting the circular member adjoining the discharge end of the rotatable drum to rotate independent of the drum.

2. Apparatus according to claim 1 in which the drum wall has axial ribs which terminate at a smooth walled radial portion of the drum which continues to the discharge end.

3. Apparatus according to claim 1 including a chute adjoining the gate for receiving processed material which comes out the gate material discharge opening.

4. Apparatus according to claim 1 in which the discharge opening has a peripheral edge portion which extends radially beyond the drum discharge end to permit material discharged from the drum to flow unimpeded over that edge portion.

5. Apparatus according to claim 4 in which the peripheral edge portion has first and second ends, the discharge opening has an approximately semicircular portion which extends from the first end of the peripheral edge portion, and ends at an approximately straight portion which extends to the second end of the peripheral edge portion.

6. Apparatus according to claim 1 including guide means which restrains movement and absorbs impact shock of the circular member, axially and radially of the drum.

7. Apparatus comprising:

a rotatable material processing cylindrical drum having a substantially horizontal axis and a circular discharge open end, a material discharge regulating gate adjoining the discharge end of the drum, said gate comprising a vertical circular member having a diameter larger than the discharge end of the rotatable drum, the circular member having a continuous surface with a material discharge opening therein, means rotatably mounting the circular member adjoining the discharge end of the rotatable drum to rotate independent of the drum, and a sprocket ring around the periphery of the circular member, and the mounting means comprises means for suspending the circular member means including a chain which meshes with the sprocket and cradles the circular member.

8. Apparatus according to claim 7 in which the sprocket ring is located in a trough.

9. Apparatus according to claim 7 in which the chain is an endless chain, and the chain is supported by at least two spaced-apart sprockets above the circular member.

10. Apparatus according to claim 7 including power means to drive the chain and thereby rotate the circular member.

11. Apparatus according to claim 7 including means to temporarily lock the chain against travel and thereby prevent rotation of the circular member.

12. A material discharge regulating gate for a rotating material processing drum, comprising:

a vertical circular member having a diameter larger than the discharge end of a rotatable drum with which it can be used, a sprocket ring around the periphery of the circular member, the circular member having a continuous surface with a material discharge opening therein, and means for rotatably mounting the circular member adjoining the discharge end of the rotatable drum so that the circular member can rotate independent of the drum rotation, with said means for rotatably mounting the circular member comprising means for suspending the circular member including a chain which meshes with the sprocket and cradles the circular member.

13. A gate according to claim 12 in which the sprocket ring is located in a trough.

14. A gate according to claim 12 in which the chain is an endless chain, and the chain is supported by at least two spaced-apart sprockets above the circular member.

15. A gate according to claim 12 including power means to drive the chain and thereby rotate the circular member.

16. A gate according to claim 12 including means to temporarily lock the chain against travel and thereby prevent rotation of the circular member.

17. A material discharge regulating gate for a rotating material processing drum, comprising:

a vertical circular member having a diameter larger than the discharge end of a rotatable drum with which it can be used, the circular member having a continuous surface with a material discharge opening therein, the discharge opening having a peripheral edge portion which extends radially beyond the drum discharge end to permit material discharged from the drum to flow unimpeded over that edge portion, the peripheral edge portion having first and second ends, the discharge opening having an approximately semicircular portion which extends from the first end of the peripheral edge portion, and ends at an approximately straight portion which extends to the second end of the peripheral edge portion, and means for rotatably mounting the circular member adjoining the discharge end of the rotatable drum so that the circular member can rotate independent of the drum rotation.

18. A method of regulating and controlling material flow or discharge from a rotating drum, comprising:

positioning a vertical circular member at the discharge end of a rotatable drum, the circular member having a continuous surface with a material discharge opening therein and also having means for rotatably mounting the circular member adjoining the discharge end of the rotatable drum, said circular member being mounted to rotate independently of the drum, rotating the drum, feeding material to the rotating drum for processing, and after processing discharging the material from the rotating drum with controlled flow by rotating the circular member independent of drum rotation to position the opening at a stationary location to effect controlled flow material discharge from the rotating drum through the opening in the circular member.

19. A method according to claim 18 in which the material constitutes long logs having a length greater than the diameter of the drum, and the logs are discharged to a receiving stationary discharge chute with reduced impact and damage thereto.

20. A method according to claim 18 in which the continuous material discharge is terminated and the drum is completely emptied by rotating the circular member to position the opening for all material to be discharged from the drum.

21. A method according to claim 18 in which the discharge opening in the circular member has a peripheral edge portion with first and second ends which extends radially beyond the drum discharge end to permit material discharged from the drum to flow unimpeded over that edge portion, and the discharge opening has an approximately semicircular portion which extends from the first end of the peripheral edge portion and ends at an approximately straight portion which extends to the second end of the peripheral edge portion.

22. A method of regulating and controlling discharge of long logs from a rotating barking drum comprising:

positioning a vertical circular member at the discharge end of a rotatable barking drum, the circular member having a continuous surface with a material discharge opening therein, and also having means for rotatably mounting the circular member adjoining the discharge end of the rotatable drum so that the circular member rotates independently of the drum, the discharge opening in the circular member having a peripheral edge portion with first and second ends which extends radially beyond the drum discharge end to permit material discharged from the drum to flow unimpeded over that edge portion, and the discharge opening has an approximately semicircular portion which extends from the first end of the peripheral edge portion and ends at an approximately straight portion which extends to the second end of the peripheral edge portion, rotating the barking drum, feeding long logs, having a length greater than the diameter of the drum, into the rotating drum, rotating the circular member to place the discharge opening therein in position for debarked log discharge through the opening at a desired controlled flow and holding the opening at such position during further log debarking.

23. A method according to claim 22 in which the opening in the circular member during log discharge has the straight portion about horizontal.

24. A method according to claim 23 in which feeding of logs to the drum is discontinued, the circular member is rotated to position the opening therein with the straight portion about vertical, and all logs in the rotating drum are discharged through the opening to completely empty the drum.

* * * * *